US008950829B2

(12) United States Patent
Kuo

(10) Patent No.: US 8,950,829 B2
(45) Date of Patent: Feb. 10, 2015

(54) CABINET WITH SLIDING DOOR

(71) Applicant: Szu-Wei Kuo, New Taipei (TW)

(72) Inventor: Szu-Wei Kuo, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 89 days.

(21) Appl. No.: 13/660,047

(22) Filed: Oct. 25, 2012

(65) Prior Publication Data

US 2014/0084767 A1 Mar. 27, 2014

(30) Foreign Application Priority Data

Sep. 25, 2012 (TW) ..... 101135035 A

(51) Int. Cl.
*A47F 3/00* (2006.01)

(52) U.S. Cl.
USPC ..... 312/139.2

(58) Field of Classification Search
CPC ..... A47F 3/005; A47F 3/043; E06B 3/4663; E06B 3/4672
USPC ..... 312/198, 199, 138.1, 139.2, 286, 312/334.24, 334.28
See application file for complete search history.

(56) References Cited

U.S. PATENT DOCUMENTS

| | | | | | |
|---|---|---|---|---|---|
| 94,016 | A | * | 8/1869 | Mayo | 312/139.2 |
| 755,580 | A | * | 3/1904 | Parrish | 312/139.2 |
| 1,186,642 | A | * | 6/1916 | Alamy | 312/114 |
| 1,322,454 | A | * | 11/1919 | Kendall | 312/224 |
| 2,192,063 | A | * | 2/1940 | Hopkins | 49/406 |
| 2,192,519 | A | * | 3/1940 | King | 49/453 |
| 2,198,436 | A | * | 4/1940 | Hoffman | 312/139.2 |
| 3,631,325 | A | * | 12/1971 | Wenz | 361/705 |
| 5,590,940 | A | * | 1/1997 | Richard | 312/287 |
| 6,793,298 | B2 | * | 9/2004 | Delph | 312/139.2 |

* cited by examiner

*Primary Examiner* — James O Hansen
(74) *Attorney, Agent, or Firm* — Novak Druce Connolly Bove + Quigg LLP

(57) ABSTRACT

A cabinet includes a top wall, a bottom wall, two opposite sidewalls, and a sliding door. One of the sidewalls defines an opening. A rail perpendicular to the sidewalls protrudes from an inner surface of each of the top and bottom walls, extends to the opening. The sliding door defines a slide slot in each of a top and a bottom. The sliding door is capable of sliding into the cabinet through the opening, with the two slide slots fitted around the corresponding rails.

15 Claims, 12 Drawing Sheets

CABINET WITH SLIDING DOOR

BACKGROUND

1. Technical Field

The present disclosure relates to a cabinet.

2. Description of Related Art

Cabinet doors are generally made of armored plates. The armored plates are heavy and mounted to the cabinets with bolts, which is difficult and time-consuming to install. Furthermore, to open the cabinet, the door of the cabinet is generally rotated about one of the sidewalls of the cabinet, so that a space for the doors rotation needs to be provided, taking up much needed space.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
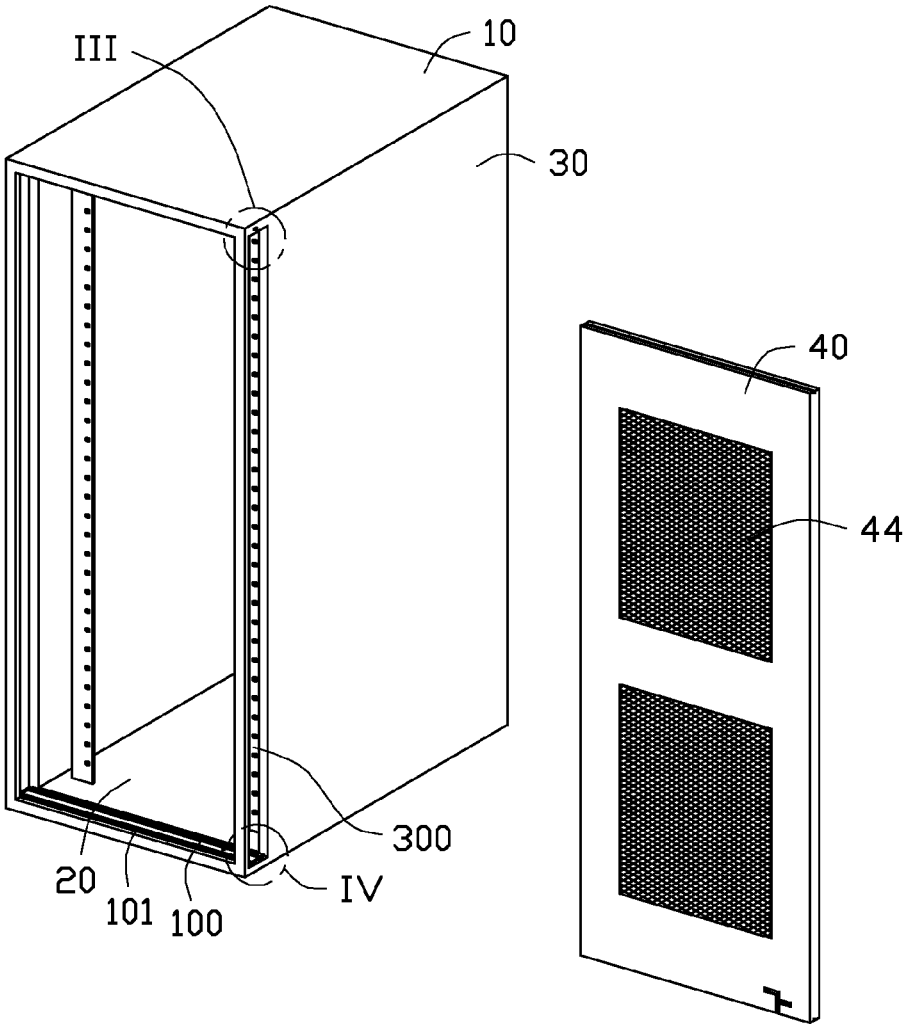
FIG. 1 is an exploded, isometric view of a first embodiment of a cabinet, wherein the cabinet includes a top wall and a bottom wall each including a first rail and a second rail, two sidewalls one of which defines an opening, and a sliding door.

FIG. 1 illustrates an embodiment of a cabinet. The cabinet includes a top wall 10, a bottom wall 20 opposite to the top wall 10, two opposite sidewalls 30 connected substantially perpendicular between side edges of the top and bottom walls 10 and 20, a rear wall (not shown) connected substantially perpendicular between rear ends of the top and bottom walls 10 and 20, and a sliding door 40.

Figure 2:
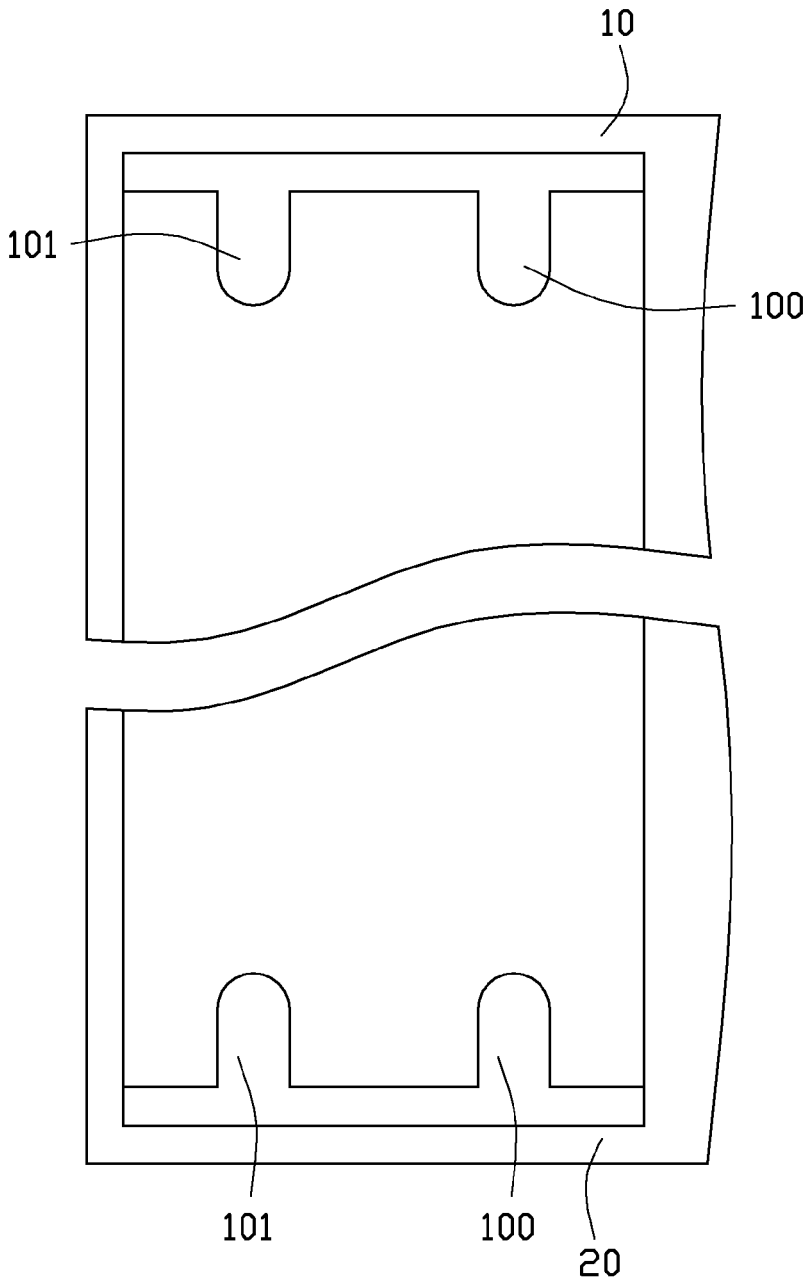
FIG. 2 is an enlarged, side plan view showing the first rails and the second rails of FIG. 1, viewed through the opening of the sidewall.
Figure 3:
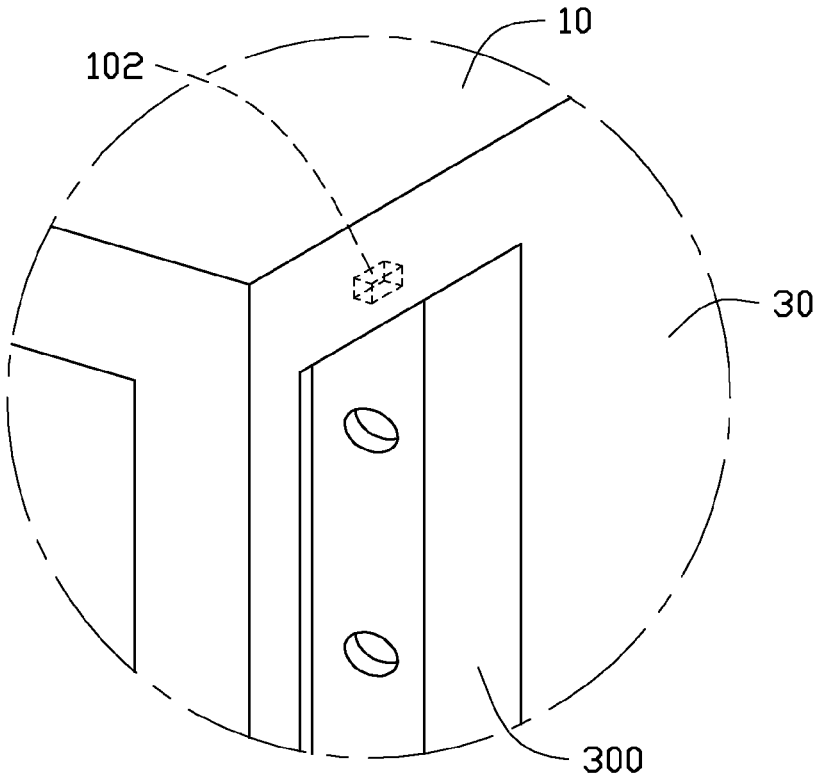
FIG. 3 is an enlarged view of the circled portion III of FIG. 1.
Figure 4:
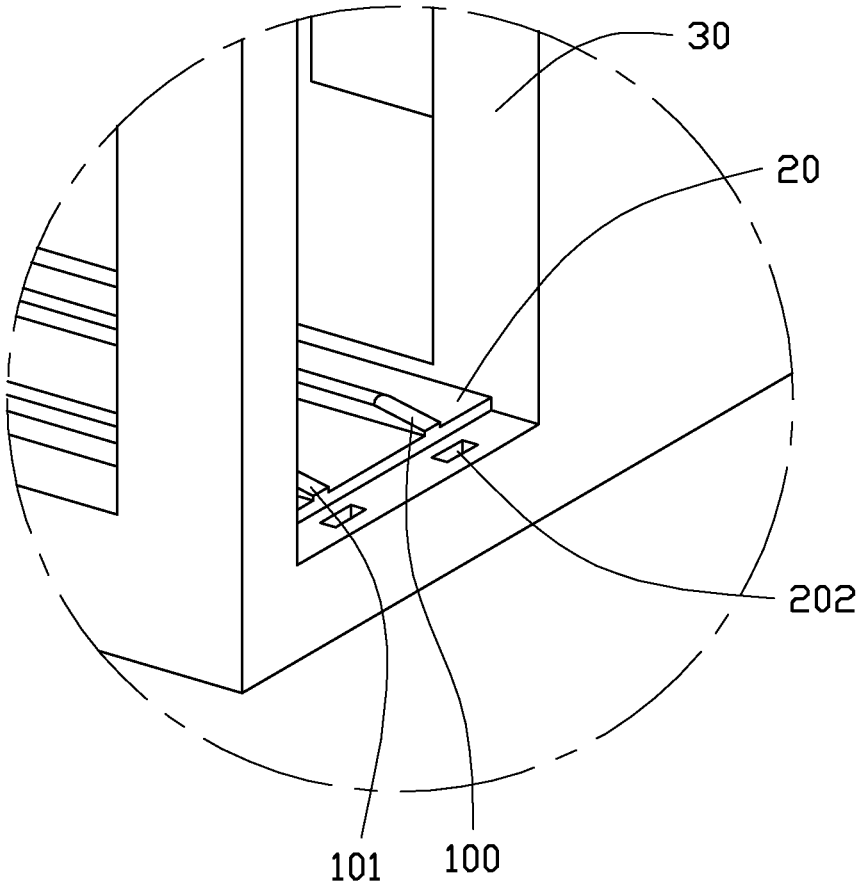
FIG. 4 is an enlarged view of the circled portion IV of FIG. 1.
Figure 5:
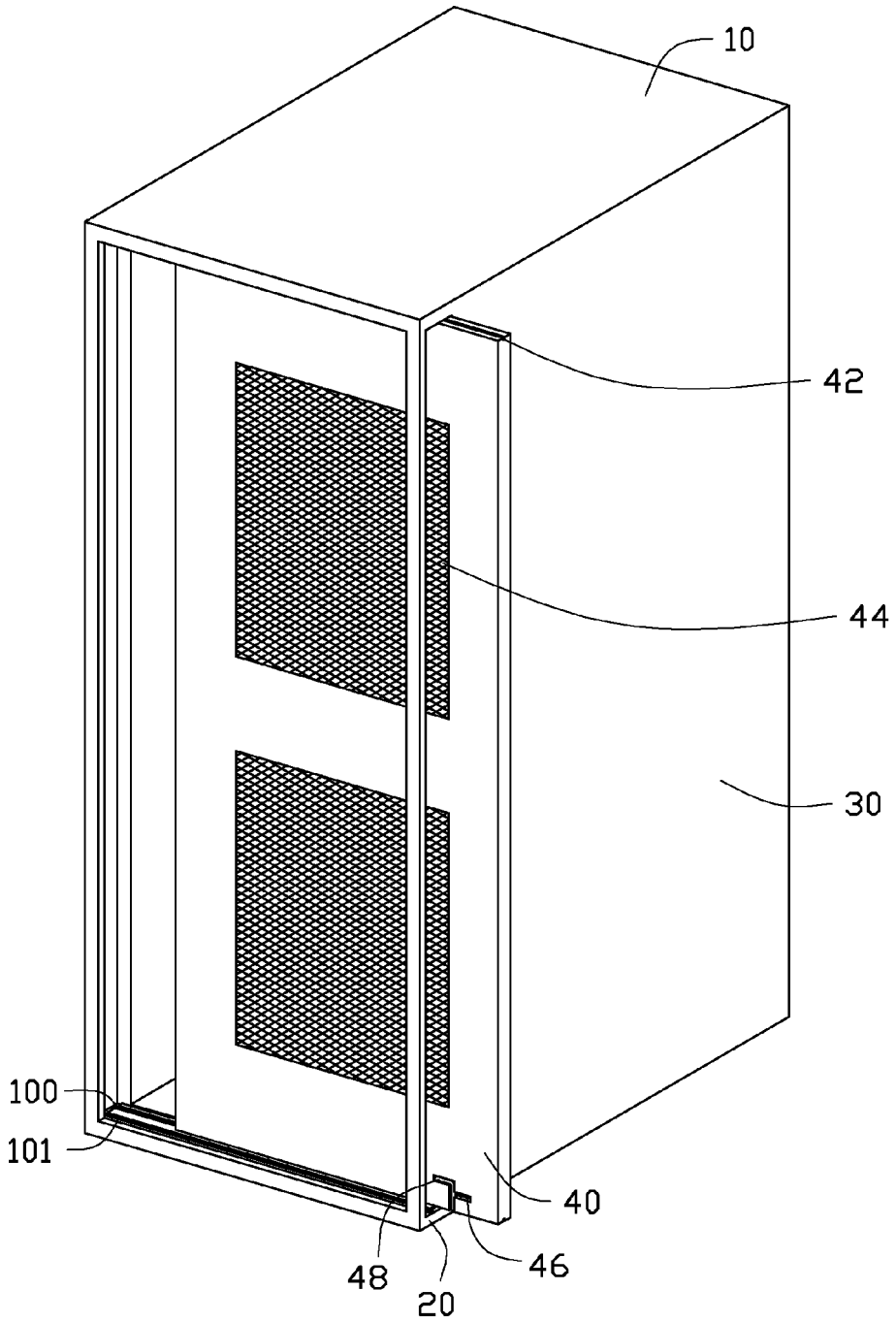
FIG. 5 is a partly assembled view of FIG. 1.
Figure 6:
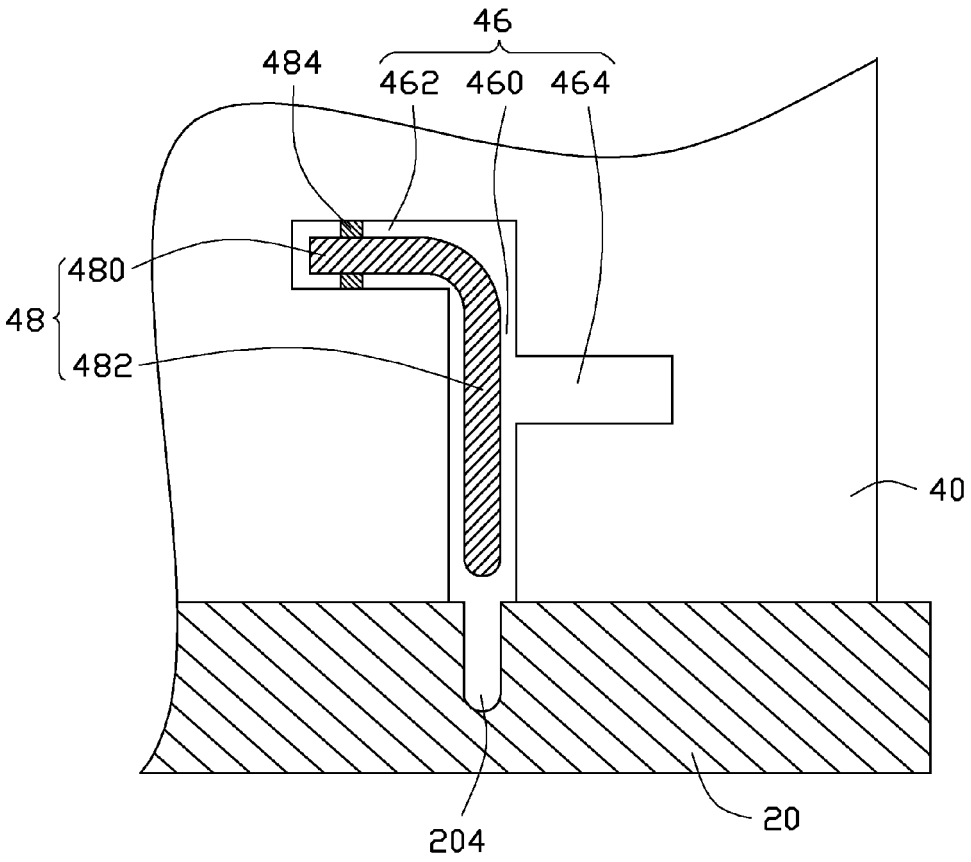
FIG. 6 is a partially cross-sectional view of FIG. 5, showing a fixing member received in a receiving portion of the sliding door.
Figure 7:
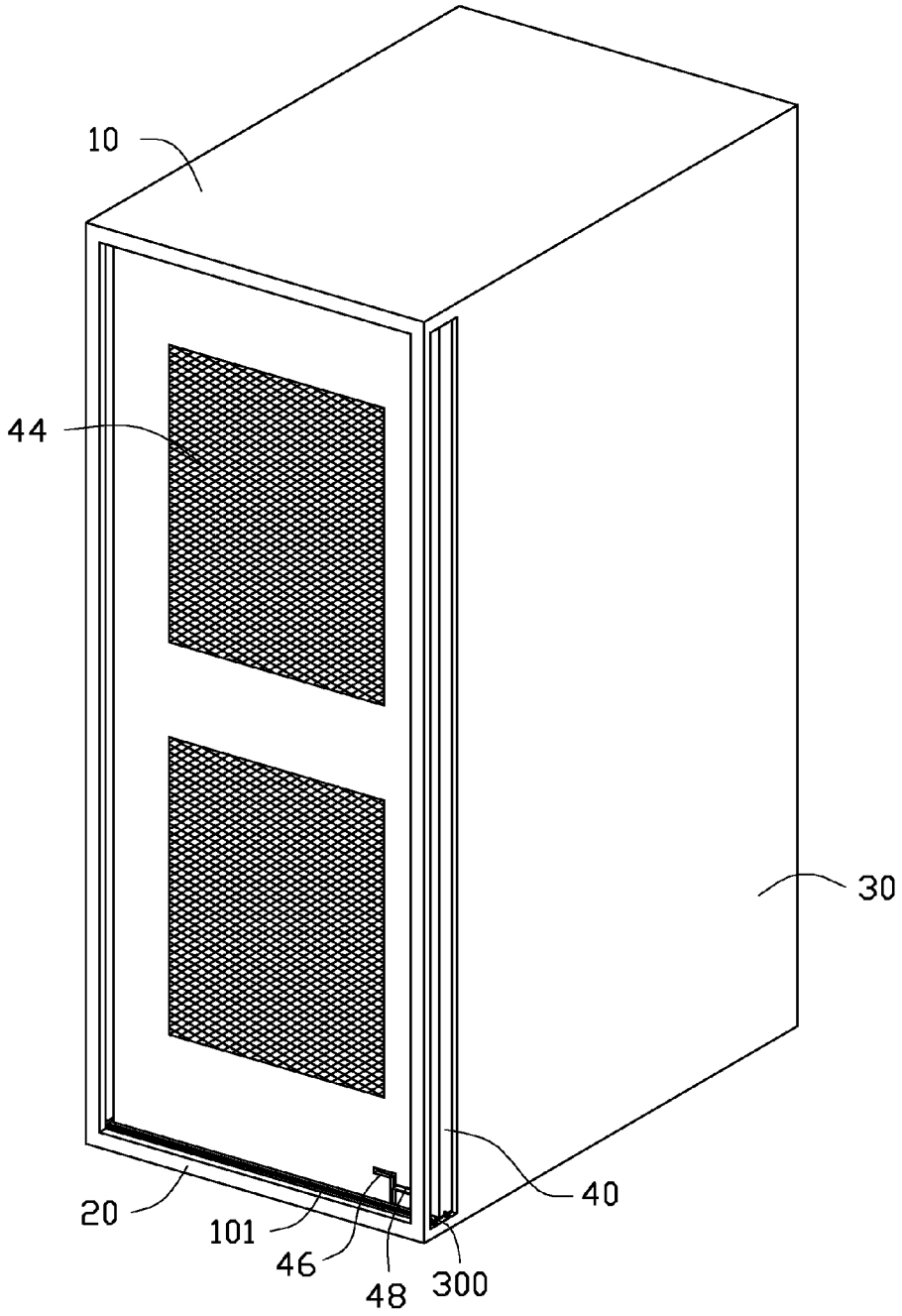
FIG. 7 is an assembled view of FIG. 5.
Figure 8:
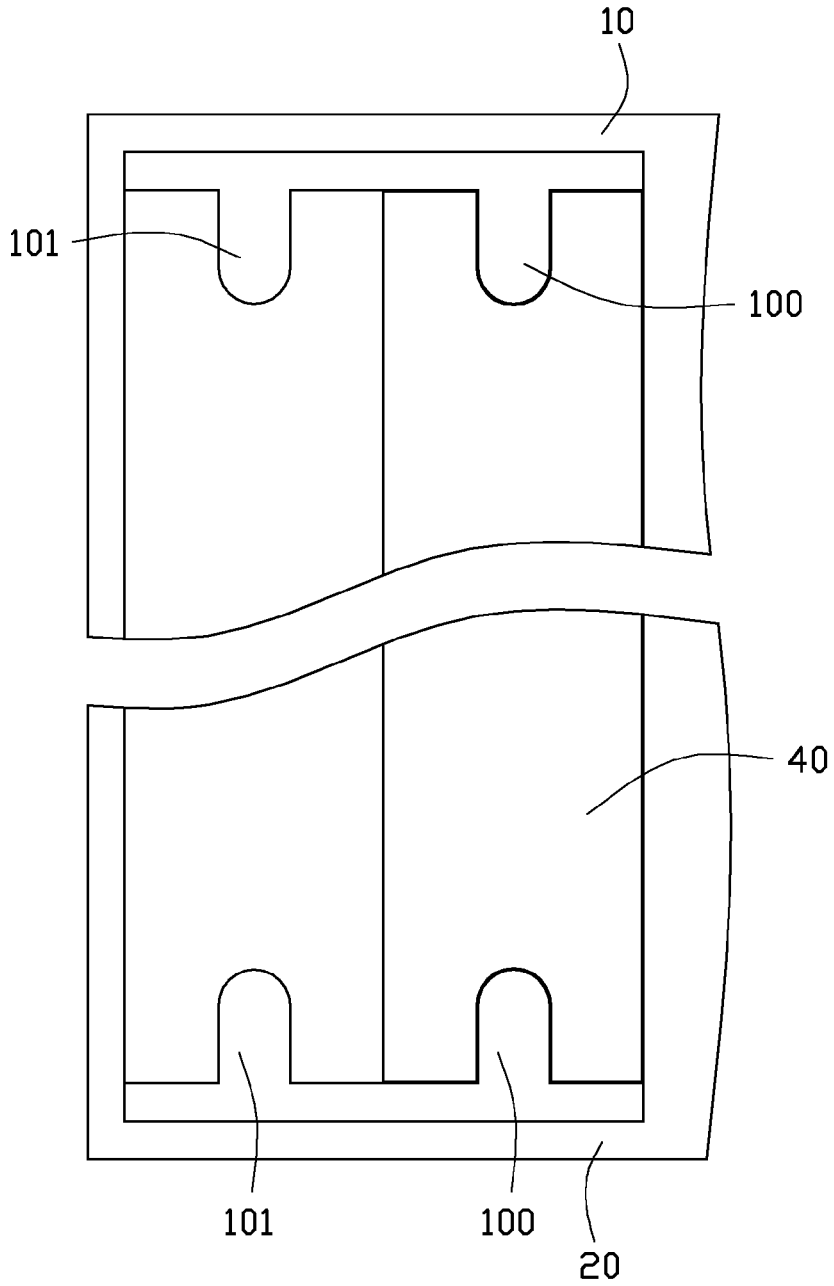
FIG. 8 is an enlarged, side plan view showing the sliding door mounted to the first rails of FIG. 7, viewed through the opening of the sidewall.
Figure 9:
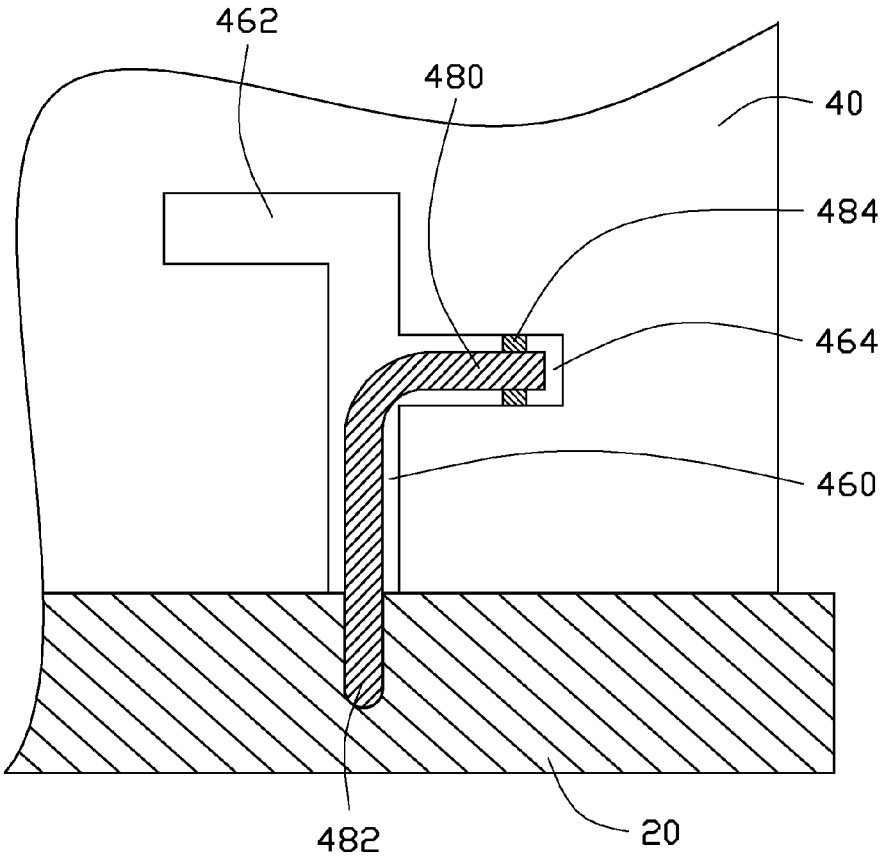
FIG. 9 is similar to FIG. 6, but showing the fixing member engaged in a fixing hole of the bottom wall.

Referring to FIGS. 2 to 4, one of the sidewalls 30 defines a vertical opening 300 adjacent to a front side of the sidewall 30. A first rail 100 and a second rail 101 behind the first rail 100 protrude from a front end of an inner surface of each of the top and bottom walls 10 and 20. The first and second rails 100 and 101 are perpendicular to the sidewalls 30 and extend into the opening 300. The top wall 10 defines a recess 102 communicating with the opening 300. The bottom wall 20 defines two positioning holes 202 communicating with the channel 300, and a fixing hole 204 (shown in FIG. 6) in front of each of the first and second rails 100 and 101.

Referring to FIGS. 5 to 9, the sliding door 40 defines a slide slot 42 extending through opposite sides of the sliding door 40 in each of a top and a bottom of the sliding door 40, a vent 44 in a center of the sliding door 40 for dissipating heat, and a receiving portion 46 in a lower portion of a front side of the sliding door 40. The receiving portion 46 receives a fixing member 48 therein. The receiving portion 46 includes a vertical slot 460 extending through the bottom end of the sliding door 40, an unlocking slot 462 perpendicularly communicating with a top end of the vertical slot 460, and a locking slot 464 perpendicularly communicating with a center of the vertical slot 460. In the embodiment, the unlocking slot 462 and the locking slot 464 extend in opposite directions. In another embodiment, the unlocking slot 462 and the locking slot 464 can extend in a same direction. The fixing member 48 includes a positioning bar 480 capable of being selectively received in the unlocking slot 462 or the locking slot 464, and an inserting bar 482 extending from an end of the positioning bar 480 and slidably received in the vertical slot 460. A resilient block 484 protrudes from each of a top and a bottom of the positioning bar 480. The resilient blocks 484 deformedly abut a top sidewall and a bottom sidewall bounding the unlocking slot 462 and the locking slot 464, to fix the fixing member 48 in the receiving portion 46.

In assembly, the sliding door 40 is received in the cabinet through the opening 300. The slide slots 42 are completely fitted around the first rails 100. The vertical slot 460 aligns with the fixing hole 204 in front of the first rail 100 of the bottom wall 20. The positioning bar 480 is pivoted forward to be disengaged from the unlocking slot 462, and the inserting bar 482 is slid down to be inserted into the fixing hole 204, to fix the sliding door 40 to the cabinet. The positioning bar 480 is then pivoted backward to be firmly received in the locking slot 464. At this time, the sliding door 40 contacts a rear sidewall bounding the opening 300.

In another embodiment, the slide slots 42 may be fitted around the second rails 101. At this time, a cover 50 (shown in FIG. 10) is needed to cover the opening 300.

Figure 10:
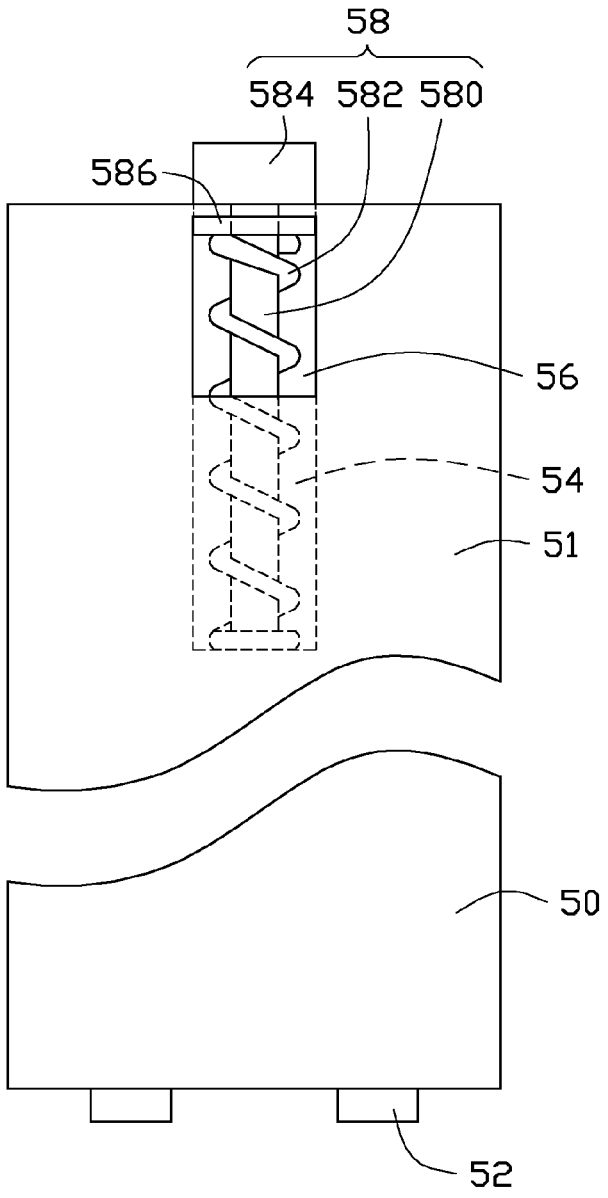
FIG. 10 is a plan view of a cover covering the opening of the sidewall of FIG. 1.

FIG. 10 shows the cover 50 including a plate 51 covering the opening 300, and a locking member 58. Two protrusions 52 protrude from a bottom end of the plate 51. The plate 51 defines a receiving space 54 extending through a top end of the cover 50 opposite to the protrusions 52, and an opening 56 communicating with the receiving space 54 and extending through one of opposite sides of the plate 51. The locking member 58 includes a post 580 having a bottom end fixed to a bottom wall bounding the receiving space 54, a spring 582 fitted around the post 580, an engaging portion 584 mounted to a top end of the spring 582 and having a lower portion movably fitted around a top end of the post 580, and a tab 586 extending from the engaging portion 584 and exposed through the opening 56. A length of the post 580 is equal to a depth of the receiving space 54. An upper portion of the engaging portion 584 extends out of the receiving space 54.

When mounting the cover 50 to the cabinet, the tab 586 is pressed downward to deform the spring 582 until the engaging portion 584 is completely received in the receiving space 54. The protrusions 52 are inserted into the positioning holes 202. The tab 586 is then released, and the spring 582 is restored to move the engaging portion 584 upward. The upper portion of the engaging portion 584 is inserted into the recess 102, to fix the cover 50 in the opening 300.

In disengaging the sliding door 40, the tab 586 is pressed downward to deform the spring 582, until the engaging portion 584 is completely received in the receiving space 54. An upper portion of the cover 50 is moved outward, and the cover 50 is then moved up to disengage the protrusions 52 from the corresponding positioning holes 202, thereby disengaging the cover 50 from the cabinet. The positioning bar 480 disengages from the locking slot 464 by pivoting forward, and the fixing member 48 is slid upward to disengage the inserting bar 482 from the corresponding fixing hole 204. Therefore, the sliding door 40 is readily slid out of the cabinet through the opening 300.

Figure 11:
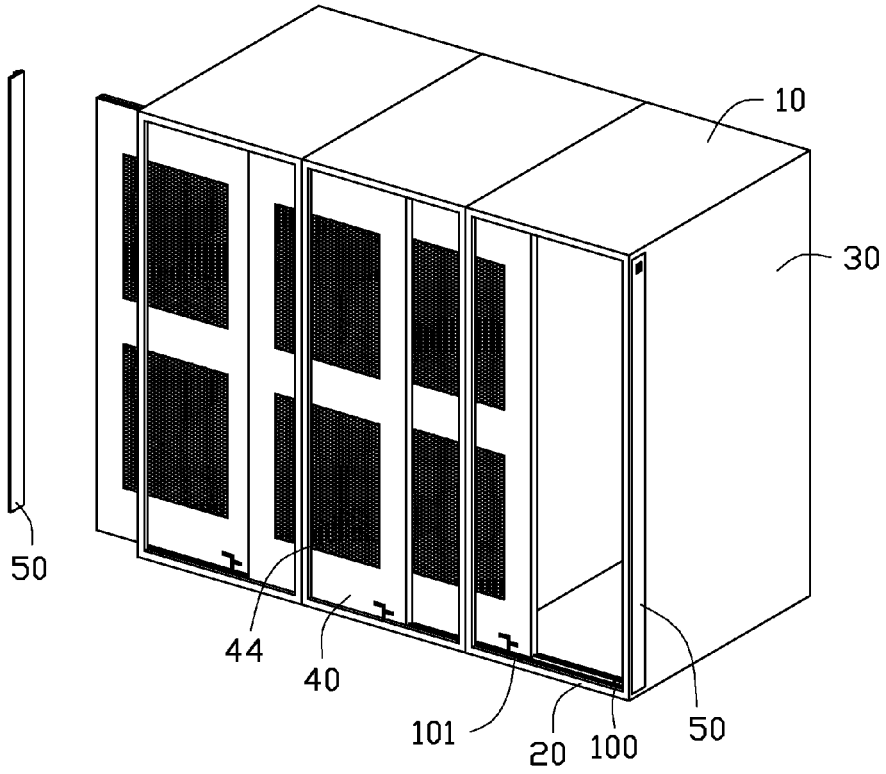
FIG. 11 is an isometric view of a state of use of the cabinet of FIG. 1.
Figure 12:
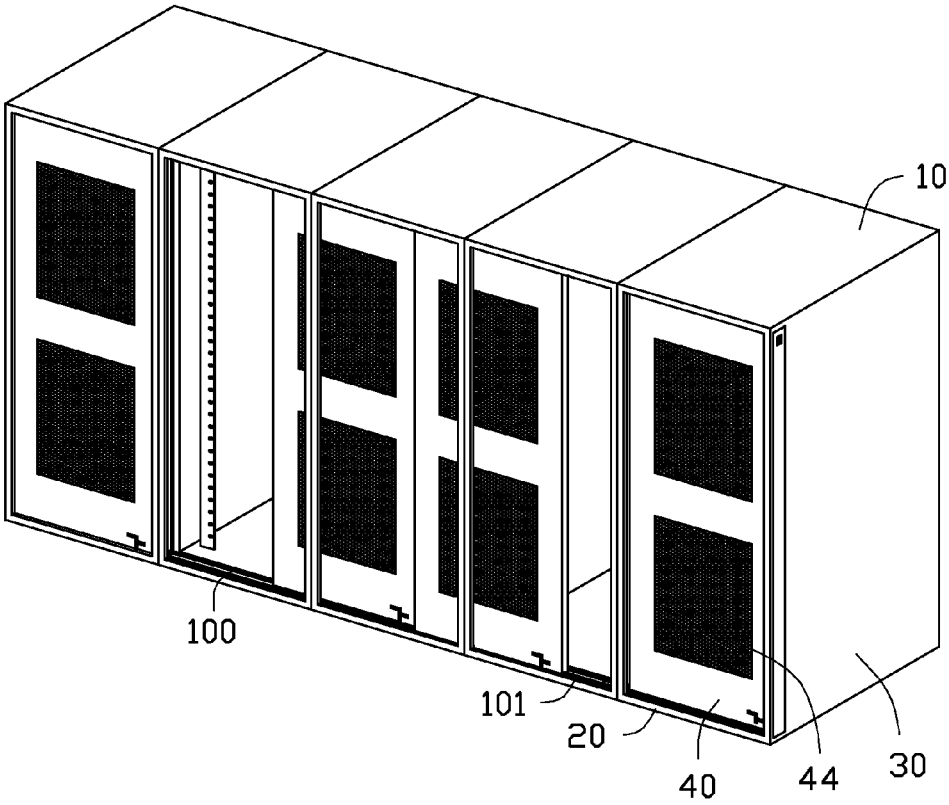
FIG. 12 is an isometric view of another state of use of the cabinet of FIG. 1.

FIGS. 11 and 12 show a second embodiment of the cabinet. In this embodiment, the sidewalls 30 each define an opening 300 adjacent to a front side of the sidewall 30. The top wall 10 defines two recesses 102 respectively communicating with the openings 300. The bottom wall 20 defines two positioning holes 202 communicating with one of the openings 300 in each of opposite ends of the front side.

In use, a plurality of cabinets is arranged side by side. The first rails 100 of the top walls 10 are arranged in a line, and the first rails 100 of the bottom walls 20 are arranged in a line. The second rails 101 of the top walls 10 are arranged in a line, and the second rails 101 of the bottom walls 20 are arranged in a line. At this time, if the sliding door 40 of a cabinet is mounted to the first rails 100, the sliding door 40 of the adjacent cabinet is mounted to the second rails 101 of the adjacent cabinet. Therefore, the sliding doors 40 are staggered from each other and received in the corresponding cabinet, such that each sliding door 40 is capable of being slid behind or in front of an adjacent sliding door 40. At this time, two covers 50 are needed to cover the outmost openings 300.

In another embodiment, the outmost channels 300 may be omitted. The sliding doors 40 are installed in the cabinets firstly, and the cabinets are then set side by side.

It is believed that the present embodiments and their advantages will be understood from the foregoing description, and various changes may be made thereto without departing from the spirit and scope of the description or sacrificing all of their material advantages, the examples hereinbefore described merely being exemplary embodiments.

What is claimed is:

1. A cabinet, comprising:

two opposite sidewalls, one of the sidewalls defining a vertical first opening;

a top wall comprising a first rail protruding up from a bottom of the top wall, the first rail being perpendicular to the sidewalls and aligning with the first opening;

a bottom wall comprising a second rail protruding down from a top of the bottom wall, the second rail being perpendicular to the sidewalls and aligning with the first opening; and a sliding door defining a slot in a top end and a bottom end of the sliding door, wherein the sliding door extends into the cabinet through the first opening, and the slide slots slidably fit around the first and second rails, respectively;

wherein a fixing hole is defined in the bottom wall adjacent to a front side of the first rail, the sliding door comprises a fixing member engaged in the fixing hole in response to the sliding door being completely received in the cabinet.

2. The cabinet of claim 1, wherein the sliding door defines a receiving portion to receive the fixing member, the receiving portion comprises a vertical slot, an unlocking slot and a locking slot communicating with the vertical slot, the locking slot is closer to the bottom wall than the unlocking slot, the fixing member comprises a positioning bar received in either the unlocking slot or the locking slot to fix the fixing member in the receiving portion, and an inserting bar extending from the positioning bar and slidably received in the vertical slot to be inserted into the fixing hole of the bottom wall.

3. The cabinet of claim 2, wherein the fixing member further comprises a resilient block protruding from the positioning bar and abutting against a sidewall bounding each of the unlocking slot and the locking slot.

4. The cabinet of claim 1, wherein a third rail protrudes from each of the top and bottom walls, parallel to and behind the corresponding first and second rails, to selectively install the sliding door.

5. The cabinet of claim 4, further comprising a cover to cover the first opening, wherein the bottom wall defines a positioning hole communicating with the first opening, the top wall defines a recess communicating with the first opening, a protrusion protrudes from a bottom of the cover to be detachably received in the positioning hole, and a locking member is set in the cover and comprises an engaging portion to be detachably received in the recess to fix the cover to the cabinet.

6. The cabinet of claim 5, wherein the cover defines a receiving space extending through a top end of the cover to receive the locking member, the locking member comprises a post fixed to a bottom wall bounding the receiving space and a spring fitted around the post, the engaging portion is fixed to the spring and slidably fitted around the post.

7. The cabinet of claim 6, wherein the cover defines a second opening communicating with the receiving space in a side of the cover, a tab protrudes from the engaging portion and is exposed through the second opening to be operated to move the engaging portion.

8. A cabinet assembly, comprising:

a first cabinet and a second cabinet arranged side by side, each of the first and second cabinets comprising:

two opposite sidewalls each defining a first opening;

a top wall comprising a first rail and a second rail protruding from a bottom of the top wall, the first and second rails being perpendicular to the sidewalls and aligning with the first openings, the second rail being located behind the first rail;

a bottom wall comprising a third rail and a fourth rail protruding from a top of the bottom wall, the third and fourth rails being perpendicular to the sidewalls and aligning with the first opening, the third rail being located below the first rail, the fourth rail being located below the second rail and behind the third rail; and a first sliding door and a second sliding door, each of the first and second sliding doors defining a slot in each of a top and a bottom, wherein the first sliding door is received in the first cabinet through one of the first openings of the first cabinet, the second sliding door is received in the second cabinet through one of the first openings of the second cabinet, the slide slots of the first sliding door of the first cabinet are fitted around the first and third rails of the first cabinet, and the slide slots of the second sliding door of the second cabinet are fitted around the second and fourth rails of the second cabinet.

9. The cabinet assembly of claim 8, wherein a fixing hole is defined in the bottom wall of each of the first and second cabinets, and located in front of each of the first and third rails, each of the first and second sliding doors comprises a fixing member to be engaged in the fixing holes of the corresponding cabinet.

10. The cabinet assembly of claim 9, wherein each of the first and second sliding doors defines a receiving portion to receive the corresponding fixing member, the receiving portion comprises a vertical slot, an unlocking slot, and a locking slot communicating with the vertical slot, the locking slot is below the unlocking slot, the fixing member comprises a positioning bar received in either the unlocking slot or the locking slot to fix the fixing member in the receiving portion, and an inserting bar extends from the positioning bar and slidably received in the vertical slot to be inserted into the corresponding fixing hole.

11. The cabinet assembly of claim 10, wherein each fixing member further comprises a resilient block protruding from the positioning bar and abutting against a sidewall bounding each of the unlocking slot and the locking slot.

12. The cabinet assembly of claim 8, further comprising two covers to cover the outmost first openings of the first and second cabinets, wherein the bottom walls define two positioning holes communicating with the outmost first openings, the top walls define two recesses communicating with the outmost first openings, a protrusion protrudes from a bottom of each cover to be detachably received in one of the positioning holes, a locking member is set in an upper portion of each cover and comprises an engaging portion to be detachably received in one of the recesses.

13. The cabinet assembly of claim 12, wherein each cover defines a receiving space extending through a top end of the cover to receive the corresponding locking member, the fixing member comprises a post fixed to a bottom wall bounding the receiving space, a spring fitted around the post, and the corresponding engaging portion is fixed to the spring and slidably fitted around the post.

14. The cabinet assembly of claim 13, wherein each cover defines a second opening communicating with the corresponding receiving space in a side, and a tab protrudes from the corresponding engaging portion and is exposed through the second opening to be operated to move the engaging portion.

15. A cabinet, comprising:

two opposite sidewalls, one of the sidewalls defining a vertical first opening;

a top wall comprising a first rail protruding up from a bottom of the top wall, the first rail being perpendicular to the sidewalls and aligning with the first opening;

a bottom wall comprising a second rail protruding down from a top of the bottom wall, the second rail being perpendicular to the sidewalls and aligning with the first opening; and a sliding door defining a slot in a top end and a bottom end of the sliding door, wherein the sliding door extends into the cabinet through the first opening, and the slide slots slidably fit around the first and second rails, respectively;

wherein a third rail protrudes from each of the top and bottom walls, parallel to and behind the corresponding first and second rails, to selectively install the sliding door;

wherein the cabinet further comprises a cover to cover the first opening, wherein the bottom wall defines a positioning hole communicating with the first opening, the top wall defines a recess communicating with the first opening, a protrusion protrudes from a bottom of the cover to be detachably received in the positioning hole, and a locking member is set in the cover and comprises an engaging portion to be detachably received in the recess to fix the cover to the cabinet.

* * * * *